US005635032A

United States Patent [19]

Bubik et al.

[11] Patent Number: 5,635,032

[45] Date of Patent: Jun. 3, 1997

[54] DOUBLE WIRE FORMER

[75] Inventors: Alfred Bubik; Hans Dahl, both of Ravensburg; Josef Dom, Baindt; Karl Müller, Horgenzell; Heinz Steckenreuter, Ravensburg; Elmer Weisshuhn, Vogt, all of Germany

[73] Assignee: Sulzer-Escher Wyss GmbH, Ravensburg, Germany

[21] Appl. No.: 422,006

[22] Filed: Apr. 12, 1995

Related U.S. Application Data

[63] Continuation of Ser. No. 71,815, Jun. 4, 1993, abandoned.

[30] Foreign Application Priority Data

Jun. 12, 1992 [DE] Germany ..... 42 19 292.7

[51] Int. Cl.[6] ..... D21F 1/00

[52] U.S. Cl. ..... 162/301; 162/300; 162/352

[58] Field of Search ..... 162/300, 301, 162/352

[56] References Cited

U.S. PATENT DOCUMENTS

| | | | |
|---|---|---|---|
| 3,585,105 | 6/1971 | Stuebe | 162/352 |
| 4,648,943 | 3/1987 | Malashenko | 162/301 |
| 5,034,098 | 7/1991 | Hergert | 162/301 |
| 5,045,153 | 9/1991 | Sollinger | 162/301 |
| 5,167,770 | 12/1992 | Bubik et al. | 162/352 |
| 5,262,010 | 11/1993 | Bubik et al. | 162/352 |

FOREIGN PATENT DOCUMENTS

| | | | |
|---|---|---|---|
| 2053239 | 2/1991 | Canada | 162/301 |
| 2055837 | 5/1992 | Canada | 162/301 |
| 136000 | 4/1985 | European Pat. Off. | 162/301 |

*Primary Examiner*—Karen M. Hastings

*Attorney, Agent, or Firm*—Townsend and Townsend and Crew LLP

[57] ABSTRACT

In a double wire former of a paper machine, a first continuous wire (1) is fed onto an at least partially curved guiding surface (4) so as to converge with a second wire (2), wherein the guiding surface (4) is movable in a form-locked manner relative to the wires. After the dewatering section described above, a further guiding surface (7) follows which, in advantageous embodiments, has an opposite sense of curvature and is fixedly located.

13 Claims, 3 Drawing Sheets

DOUBLE WIRE FORMER

This is a Continuation of application Ser. No. 08/071,815, filed Jun. 4, 1993, now abandoned.

FIELD OF INVENTION

The invention relates to a double wire former, the term wire being commonly used in the art of paper making to refer to a sieve.

The double wire former comprises a first wire and a second wire. A suspension layer is formed on the first wire. The first wire together with the suspension layer is then fed into a sheet forming section formed by a guiding surface, this guiding surface being at least partially curved in the wire running direction. Also in the sheet forming section, a following guiding surface for the second wire through which water passing through can be sucked off is provided on the side of the second wire lying opposite to the suspension layer.

TECHNICAL BACKGROUND

Such a double wire former is part of a paper machine and serves substantially to dewater a fiber suspension intended for paper production which is spread out on a permeable wire surface in order to distribute or arrange the component parts contained in the suspension in a desired form. In this stage of the paper production one normally speaks of sheet forming, web forming or formation. This stage determines the quality of the subsequently produced paper to quite a substantial degree.

It has been shown in many cases that sheet forming on a curved surface between two paper machine wires brings advantages. In this case, the water is forced out of the suspension and through the wire by the wire pressure occurring as a result of the curvature and the wire tension. The dewatering can in this case be further reinforced by under-pressure. Furthermore, an influencing of the sheet forming process, for example by pressure or suction shocks is known. For the design of such a double wire former, a complex field of parameters is available which, on the one hand, leads to a large scope for influencing the paper web produced but, on the other hand, requires a high complexity of the machinery and the control equipment. Even in utilising the state of knowledge, the expert has to occasionally accept unsatisfactory results if the paper web is sensitive and if a particularly even distribution of all the web components is required.

PRINCIPAL OBJECT OF THE INVENTION

The object of the present invention is to create a double wire former with which a very even formation is possible and which can be adjusted over a wide range.

It is a further object of the present invention to satisfy the above objects in such a manner that the complexity of the machinery is kept as low as possible.

BRIEF DESCRIPTION OF THE INVENTION

The object is satisfied in a double wire former of the initially named kind in that the second wire is fed onto the suspension layer in the region of the curved guiding surface for the first wire and in that the guiding surface is movable and supported in a force-locked manner substantially in the direction to and from this wire.

Through the measures in accordance with the invention, the suspension layer which still contains much water and is therefore very delicate, can be dewatered gently and with good formation. In accordance with the invention, the guiding surface of the first wire is not, for instance, rigidly positioned, but rather pressed by a force which is directed substantially against the wire, i.e. which is pressed in a force-locked manner against the under-wire loop, wherein the force so applied supports substantially the wire tension of the first wire, partly that of the second wire and the weight forces. Depending on the constructional design, a damping of oscillating wire forces is also possible. The advantage of the invention comes especially into use if other wire guiding parts are rigidly positioned in the immediate neighborhood of the guiding surfaces guided in a force-locked manner. Furthermore, the shoe can yield to the wire ("soft nip entrance") even for instance for a suspension of uneven height. This all results in a soft formation as is especially coveted, for instance, for writing and printing paper. But also other types of paper require a good evenness of sheet.

Through the choice of the wire tension and of the radii of curvature, the double wire former can be optimally adjusted to the desired paper quality.

As a result of, on the one hand, the fixed pre-given curvature and, on the other hand, the force regulated positional change, gradual transitions in the wire guiding in the region of the former results, which is especially important for a reversal in the direction of curvature.

The dewatering can be improved with minimal shear movement by the reversal of the direction of curvature of the still very moist web fed between the wires, without damage to the web occurring thereby.

As a rule, the guiding surface located in the second wire has the mentioned opposed direction of curvature. In this region, the remaining water can be particularly effectively conducted into a suction roll or suction box with the support of suction. The suction box can contain an, with regard to the running direction, forwardly lying suction slit, which extends into the region of the curved guiding surface located in the first wire and thus into the region before the reversal of the direction of curvature.

Because of the embodiment of the double wire former in accordance with the invention, in many cases a suction box can be fixedly mounted in the second wire, i.e. it must not be adjustable during operation of the plant, or a fixedly installed suction roll may also be provided. Often, the forces which adjust themselves automatically, corresponding to the wire tension and the adjusted supporting force for the guiding surface located in the first wire, are adequate in order to position the elements of the double wire former relative to each other in the desired manner without the position of further guiding surfaces being changed. Naturally, the provision of a further rigidly positioned dewatering device before the yielding guiding surface is conceivable.

LISTING OF FIGURES

The invention and its advantages are described with the aid of drawings which are briefly listed in the following:

FIG. 1 a schematic representation of the subject of the invention as a hybrid former, FIG. 2 a schematic representation of the subject of the invention as a gap former, FIG. 3 a schematic detailed view from the subject of the invention, FIGS. 4 to 6 schematic detailed views of further embodiments, FIGS. 7 and 8 a schematic representation of the subject of the invention as a vertical former.

DESCRIPTION OF PREFERRED EMBODIMENTS

Figure 1:
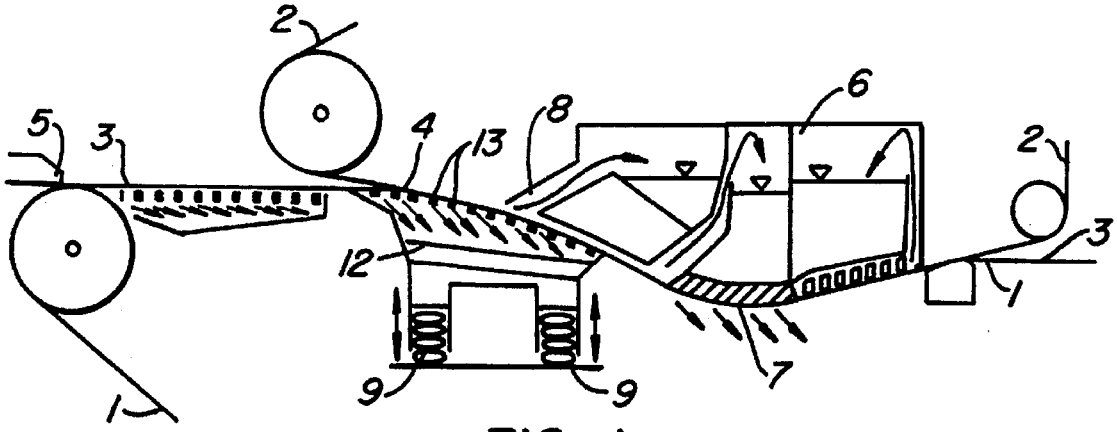
Figure 2:
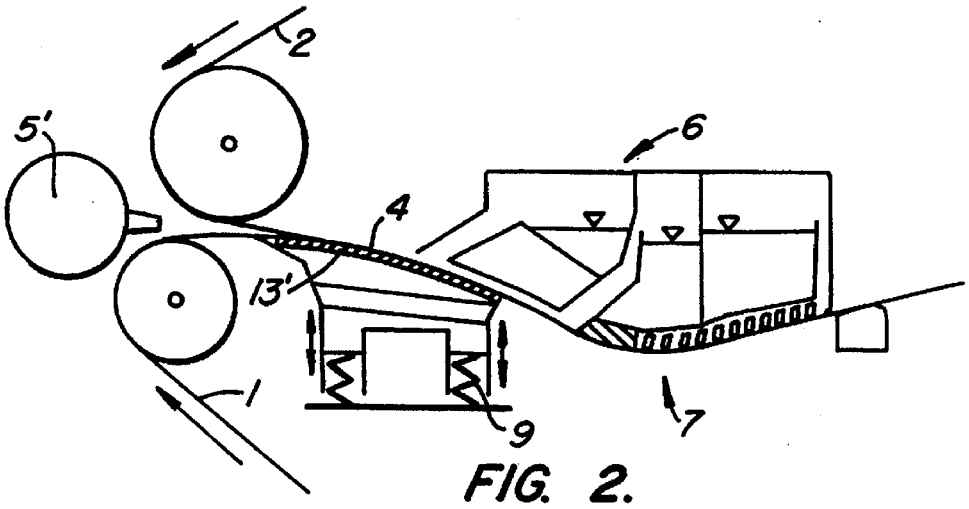

FIG. 1 shows schematically an embodiment of the double wire former in accordance with the invention. A moved endless first wire 1, constructed at first here as a longitudinal wire, is provided with a suspension layer 3 by a material outlet 5. The suspension layer 3 then gives up a part of the water which it contains through the first wire 1 which leads the suspension layer 3 lying on it into the following sheet forming section which lies on a curved guiding surface 4 above a wire table 12. The wire table 12 is, as seen in the running direction of the wire, supported at the front as well as at the back by force elements 9 and is movable in the direction of the wire (double headed arrows). The resilient support (9) uniformly supports the first curved guiding surface (4). The curved guiding surface (4) yields in a direction transverse to the suspension layer (3) and toward and away from the guide wire (1). The curved guiding surface (4) is capable of yielding to forces exerted by the first and second wires (1,2) on all points of its surface. In this manner, the angle set between the suspension layer (3) and the curved guiding surface (4) is kept substantially constant. This provides a soft nip entrance for the suspension layer during normal forming operations. The second wire 2 is, as the upper wire in the mentioned sheet forming section, fed approximately tangentially onto the suspension layer 3 located on the first wire 1, wherein the second wire 2 approaches substantially the form of the first wire from this contact line on. The suction box 6 installed in the second wire diverts water off upwardly through the second wire 2. (The water is shown in this figure by arrows). The suction box 6 is disposed substantially after the sheet forming region 5, but can also have at least some effect in the sheet forming region. Due to the guiding surface 7 of the suction box 6 facing towards the second wire having a differently directed curvature than in the sheet forming region, a curvature reversal results, as seen in the running direction of the double wire. Geometrically expressed, the center of the radius of curvature is initially below the wire and later, i.e. in the region of the suction 6, above the wire. The first suction slit 8 of the suction box 6 can be moved up into the sheet forming region so that this effect is already present relatively far in front of the actual suction box 6. As can be seen in FIGS. 1 and 2, a first closed member forms the beginning of the second guiding surface 7 which is at least as twice as long as members following this first closed member.

Figure 3:
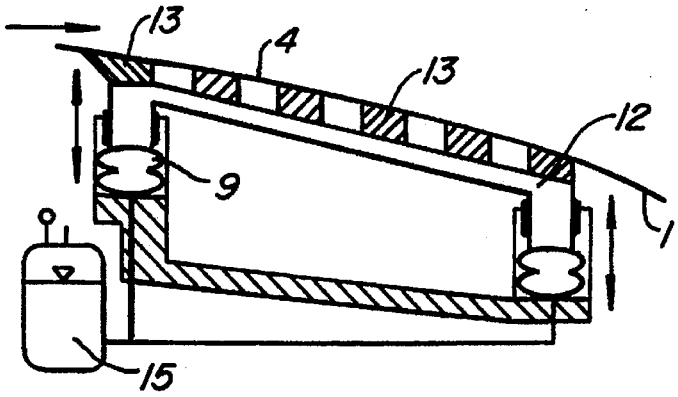

As is shown in somewhat more detail but still schematically in FIG. 3, one sees in this example one of the possibilities of forming the curved guiding surface 4. The members 13 are in this case so arranged and formed on the wire table 12 that the entirety of their surfaces facing towards the first wire 1 forms a convex contour. It is expedient to also provide the surfaces of the individual members themselves with a radius of curvature which corresponds approximately to the radius of curvature of the guiding surface 4. Deformable containers are shown as the force elements 9 which can be filled with a pressure medium. In this way, a force can be produced in these elements, which, in the intended region of operation, is independent as far as possible from the position of the wire table 12. In special cases it can be meaningful to make the pressure adjustable wherein the advantage of the yielding for forces which are too high and the damping for oscillating forces is retained. In this example, the pressure is generated in a pressure vessel 15 which is connected to the force elements 9 by feed-throughs. This arrangement is additionally capable of damping oscillations as a result of the hydraulic resistance in the feed-throughs. If necessary, the containers can be loaded with different pressures. As is later described, further elements for the production of the guiding surfaces are also conceivable. The part of the double wire former shown may also be constructed as a suction box, in other words, so that the water between the members 13 is sucked downwardly.

Whereas FIG. 1 shows the example of a hybrid former, FIG. 2 shows a so-called gap former. In such a former, the longitudinal wire section is dropped and the material outlet 5' feeds the suspension, which is in a wide stream, directly into the region of the wire unification. As a further embodiment variant, the curved guiding surface 4 is produced here by a plate 13' instead of by members, additionally the force elements 9 were constructed as springs. These forms are however not connected with the presence of a hybrid former, rather to be chosen depending on various points of view. This also applies for the following figures.

Figure 4:
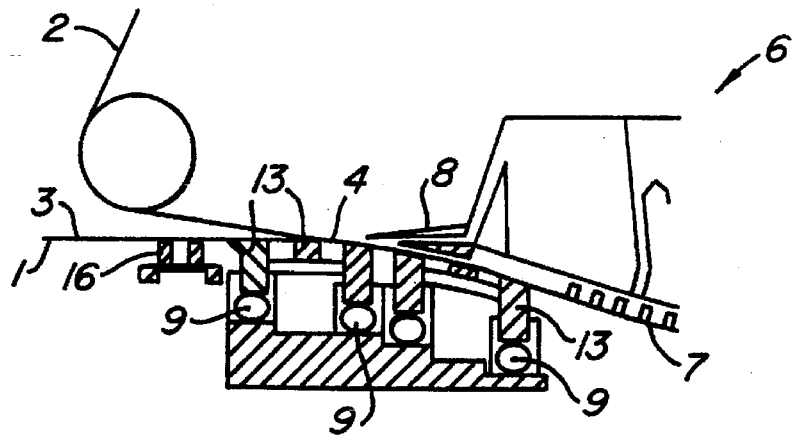
Figure 5:
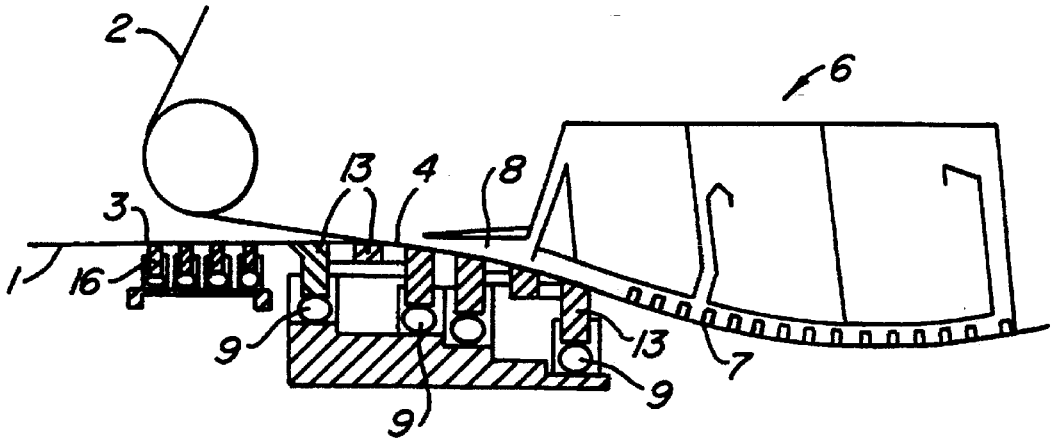

The paper forming region can namely be constructed yet differently, for instance FIG. 4 shows a number of members which are rigidly connected with each other in groups, wherein in turn every group has force elements not only at the start but also at the end, as seen in the wire running direction. Furthermore, one sees in the first wire 1 in front of the already described guiding surface 4 a unit provided with two members 16 which is fixedly mounted, which can feed the first wire and which can effect a pre-dewatering of the web. Members 16' can also be provided at this point which can be pressed towards the wire 1 in a yielding, i.e. form-locked, manner (FIG. 5).

Figure 6:
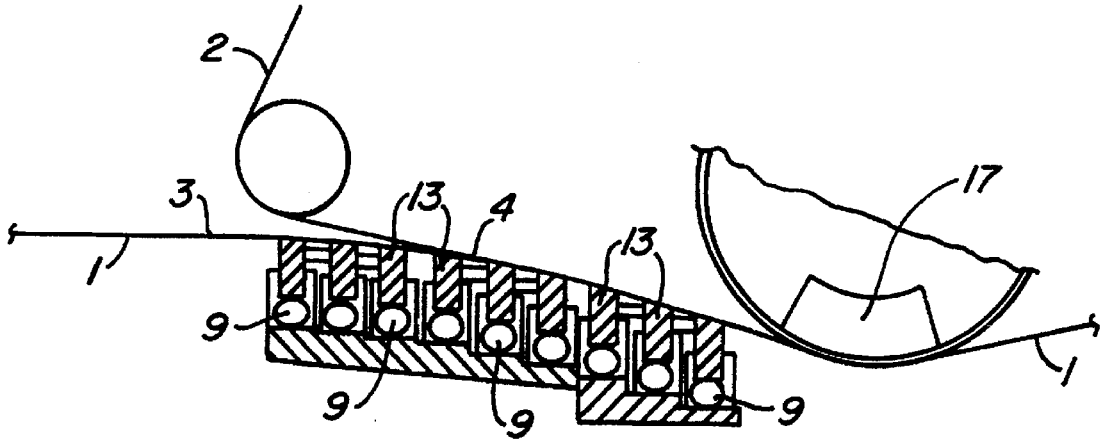

FIG. 6 shows a further variant, namely pressure members which are partly rigidly connected to each other and which are each provided with their own force elements. Furthermore, the guiding surface 7 for the second wire 2 is formed here by a suction roll 17.

Figure 7:
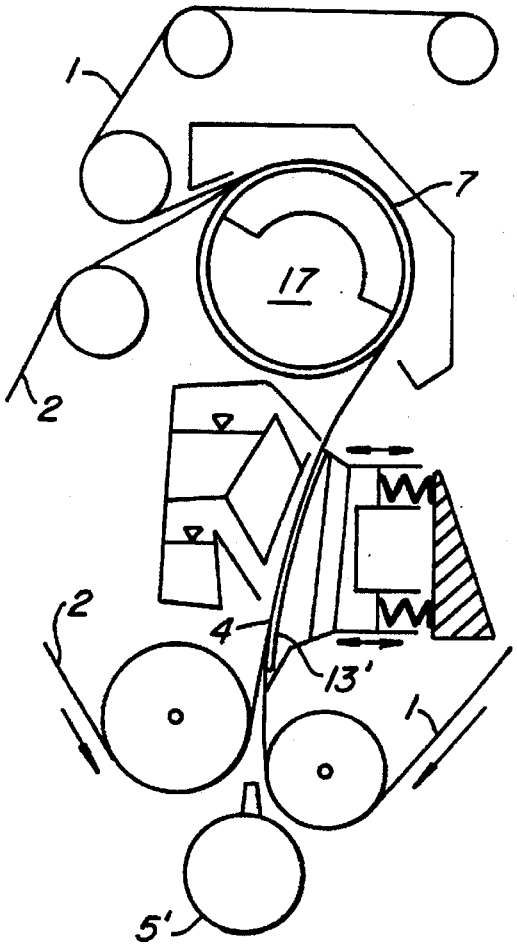
Figure 8:
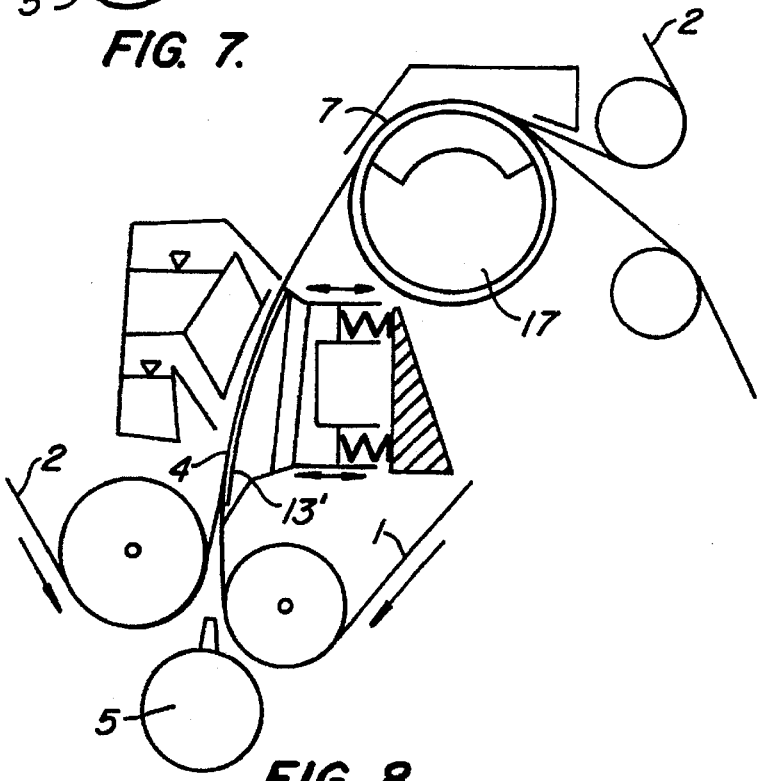

FIGS. 7 and 8 show very schematically that the double wire former in accordance with the invention can also be a vertical former. In this case, the suspension is squirted in as a wide stream substantially vertically between the wires 1 and 2. The guiding surface 4 of the first wire 1 is to be found in the region of the convergence of the wires. The water is fed off through both wires. The adjoining guiding surface 7 can be formed by a suction or also a forming roll. It is shown in FIG. 8 that in the special case the roll can have the same direction of curvature as the preceding guiding surface 4.

We claim:

1. Double wire former comprising a first wire (1) and a second wire (2), wherein a suspension layer (3) is formed on the first wire (1) and wherein the first wire (1) together with the suspension layer (3) is fed into a sheet forming section formed by a first guiding surface (4) which is at least partially curved in the wire running direction, said double wire former further comprising a support for resiliently supporting said first guiding surface at an angle with respect to said suspension layer; in said sheet forming section, the second wire (2) is brought into contact with the suspension layer (3) located on the first wire (1) and wherein a second guiding surface (7) for the second wire (2) through which water passing through can be sucked off is provided on the side of the second wire (2), lying opposite to the suspension layer, wherein in said sheet forming section said support resiliently supports said first guiding surface (4) against said first wire (1) and said second wire (2) so that said first guiding surface (4) can yield to forces exerted on said first and second wires (1, 2) by said suspension layer (3) in a direction substantially transverse to said suspension layer (3), said support being configured against said first guiding surface such that said angle between said first guiding surface and said suspension layer is maintained substantially the same when said first guiding surface yields to forces exerted on said first and second wires; wherein said second guiding surface is constructed as a suction box (6) formed by members which extend substantially transverse to said suspension layer and wherein a first closed member, as seen in the running direction, forms the beginning of said second guiding surface (7) at the suction box (6) and has a curvature with a direction which is opposed to said first guiding surface (4); wherein said first closed member, as seen in the running direction, is at least twice as long as the members of the suction box following said first closed member.

2. Double wire former as set forth in claim 1, wherein said resilient support comprises a first force element (9) which is present at a beginning of said first curved guiding surface (4) as seen in the running direction and a second force element (9) which is present at an end of said first curved guiding surface (4) as seen in the running direction.

3. Double wire former as set forth in claim 2, wherein said first and second force elements (9) are elastic.

4. Double wire former as set forth in claim 1, wherein said first guiding surface (4) is impermeable.

5. Double wire former as set forth in claim 1, wherein said first guiding surface (4) is formed with openings or slots.

6. Double wire former as set forth in claim 4, wherein said first guiding surface (4) is elastic.

7. Double wire former as set forth in claim 1, wherein said first guiding surface (4) is formed by a shoe (12) provided with members (13) which extend substantially transverse to said suspension layer (3).

8. Double wire former as set forth in claim 7, wherein said members (13) have a surface curvature which corresponds substantially to the total curvature of said first guiding surface (4).

9. Double wire former as set forth in claim 1, wherein said resilient support comprises force-producing elements (9') and wherein said curved guiding surface (4) for the first wire (1) is formed by individual members (13') which are rigidly connected with each other and wherein said force-producing elements (9') are provided under said individual members (13').

10. Double wire former as set forth in claim 9, wherein said individual members (13') are rigidly connected with each other in groups.

11. Double wire former as set forth in claim 1, wherein a first suction slot (8) located in the second wire (2) is effective in the region immediately after the wires (1 and 2) converge.

12. Double wire former as set forth in claim 1, wherein at least one further fixed guiding surface is provided which touches the first wire (1) and is separated from and in front of said first guiding surface (4).

13. Double wire former as set forth in claim 1, including means (15) are provided for damping vertical oscillations of said first guiding surface (4).

* * * * *